US008336559B2

(12) United States Patent
Kallabat et al.

(10) Patent No.: US 8,336,559 B2
(45) **Date of Patent: *Dec. 25, 2012**

(54) HAIR EXTENSION SYSTEM

(75) Inventors: Kennice Kallabat, Birmingham, MI (US); Maysoon Kattula, Rochester Hills, MI (US)

(73) Assignee: Klix Hair, Inc., Birmingham, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/834,695

(22) Filed: Jul. 12, 2010

(65) Prior Publication Data

US 2010/0275940 A1 Nov. 4, 2010

Related U.S. Application Data

(63) Continuation of application No. 11/809,656, filed on Jun. 1, 2007, now Pat. No. 7,753,057.

(51) Int. Cl.
*A41G 3/00* (2006.01)
*A41G 5/00* (2006.01)

(52) U.S. Cl. ..... 132/201; 132/53

(58) Field of Classification Search ..... 132/201, 132/53–56

See application file for complete search history.

(56) References Cited

U.S. PATENT DOCUMENTS

| | | | | |
|---|---|---|---|---|
| 3,809,099 | A * | 5/1974 | Goldberg et al. | 132/53 |
| 5,085,233 | A * | 2/1992 | Motoori et al. | 132/54 |
| 5,107,867 | A | 4/1992 | Barrington | |
| 5,121,761 | A | 6/1992 | Meister | |
| 5,575,298 | A * | 11/1996 | Hinton | 132/200 |
| 5,722,434 | A | 3/1998 | Walker | |
| 5,752,530 | A | 5/1998 | Traintinger et al. | |
| 5,813,418 | A | 9/1998 | Pillars | |
| 5,868,145 | A | 2/1999 | Spann | |
| 5,881,737 | A | 3/1999 | Nelson | |
| 5,894,846 | A | 4/1999 | Gang et al. | |
| 5,899,209 | A | 5/1999 | McDonald et al. | |
| 6,022,380 | A * | 2/2000 | Satoh | 8/405 |
| 6,135,122 | A | 10/2000 | Campbell et al. | |
| 6,405,736 | B2 | 6/2002 | Townsend | |
| 6,446,636 | B1 | 9/2002 | Vittallo | |
| 6,688,315 | B1 | 2/2004 | Harrison | |
| 6,820,625 | B2 | 11/2004 | Park | |
| 6,837,249 | B2 | 1/2005 | Smith | |

(Continued)

FOREIGN PATENT DOCUMENTS

JP 10-060721 A 3/1998

(Continued)

OTHER PUBLICATIONS

International Search Report for PCT/7S2008/065511 dated Jul. 24, 2008.

*Primary Examiner* — Robyn Doan
(74) *Attorney, Agent, or Firm* — Rader, Fishman & Grauer PLLC

(57) ABSTRACT

A hair extension system provides a skin weft of flexible material having hair like fibers uniformly displaced thereon. Micro rings are fixed to the skin weft and provide an anchoring feature for strands of human hair from a scalp to be secured thereto. The micro rings are deformable and include a flexible protectant so as to minimize damage to the strands of hair. The hair system may be reused by re-opening the micro rings and reinstalling the hair extension system to another location.

18 Claims, 7 Drawing Sheets

U.S. PATENT DOCUMENTS

| | | | | |
|---|---|---|---|---|
| 6,938,624 | B2 | 9/2005 | Arroyo et al. | |
| 7,032,602 | B2 | 4/2006 | Chang et al. | |
| 7,753,057 | B2 * | 7/2010 | Kallabat et al. | 132/201 |
| 7,854,233 | B2 * | 12/2010 | Freelove | 132/201 |
| 2003/0154994 | A1 | 8/2003 | Ra | |
| 2004/0149301 | A1 | 8/2004 | Arroyo et al. | |
| 2004/0173233 | A1 | 9/2004 | Tokko | |
| 2005/0011530 | A1 | 1/2005 | Chang | |
| 2005/0061346 | A1 | 3/2005 | Song | |
| 2005/0194015 | A1 | 9/2005 | Watts | |
| 2005/0252517 | A1 | 11/2005 | Salinas | |
| 2005/0252518 | A1 | 11/2005 | Salinas | |
| 2006/0005848 | A1 | 1/2006 | Arroyo et al. | |
| 2006/0060212 | A1 | 3/2006 | Rodriguez | |
| 2006/0065280 | A1 | 3/2006 | Cheung | |
| 2006/0086368 | A1 | 4/2006 | Salinas | |
| 2006/0169296 | A1 | 8/2006 | Gill et al. | |
| 2006/0169297 | A1 | 8/2006 | Gill et al. | |
| 2006/0180171 | A1 * | 8/2006 | Kim | 132/201 |
| 2006/0191550 | A1 | 8/2006 | Frazier | |
| 2007/0006890 | A1 | 1/2007 | Sthair | |
| 2007/0261708 | A1 * | 11/2007 | Makino et al. | 132/201 |
| 2008/0257369 | A1 * | 10/2008 | Poole | 132/53 |

FOREIGN PATENT DOCUMENTS

| | | | |
|---|---|---|---|
| KR | 20-0272636 | Y1 | 4/2002 |
| KR | 20-0334383 | Y1 | 11/2003 |

* cited by examiner

HAIR EXTENSION SYSTEM

TECHNICAL FIELD

The present invention pertains to hair accessories and more particularly, to a hair extension system and a method of installing a hair extension to human scalp hair.

BACKGROUND AND SUMMARY OF THE INVENTION

A variety of hair accessories have been developed to adorn the human hair in order to enhance one's beauty. Many of these hair accessories include adding ornaments to the hair as a fashion accessory. Some fashion accessories include use of clips, pony tail holders, and other artificial members in order to further adorn the human hair.

It has also been desirable to adorn the human hair with artificial hair from others so as to provide varied colorations that are distinct from the natural human head of hair. It has also been desirable to provide both natural and artificial hair in the form of hair extensions that a user can use to adorn their existing head of hair. Some methods of attaching these hair extensions have included taping strands of auxiliary hair to the natural hair of the human head. It has been found that this type of attachment mechanism can fail when the adhesive degrades thus no longer providing its holding characteristics. Thus, there is a need to provide an improvement over this old method of attaching hair to the human scalp.

Accordingly, there is a need to provide an improved hair extension system as well as an improved method of installing the hair extension system. While this is not to be considered limiting in any way, one form of the present invention includes providing a weft of material, having a plurality of hair fibers secured thereto, locating collapsible micro rings in spaced apart relationship to a side of the weft of material, and having strands of human hair from the scalp passed through each micro ring. Once the hair extension has been properly positioned, the micro rings are then crimped around the strand of natural hair, thus creating a temporary mechanical connection. To remove the hair extension from the scalp, the micro rings can be de-crimped thus allowing the strand of hair to be removed from the micro rings. This allows the hair extension to be removed from the head of hair, without damaging the natural hair fibers of a consumer.

Another form of the present invention includes providing a hair extension system having a weft of material made of elastomeric material, preferably skin like, with strands of auxiliary hair being densely positioned throughout the weft of material. Micro rings are positioned at a location near an upper edge or middle of the weft of material, and are secured thereto by a fastening member. The micro rings are comprised of deformable material, and have a silicon insert or film like material positioned within the micro ring, for protecting the human hair of strand that is placed there through. The micro rings may be repeatedly crimped and de-crimped, so as to make the hair extension reusable over and over again.

According to another aspect of the present invention, a method of installing a hair extension system includes the steps of separating the head of hair and creating a distinct section in which the hair extension will be installed, unrolling a length of hair extension material to a desired length and cutting a desired section of hair extension material. Next, the cut section of hair weft extension material is placed adjacent to the scalp in approximate location to where it is to be installed. Strands of natural hair fiber are then grasped by a hook member and pulled through the opening of the ring member so that the hair strand extends through the micro ring. This step is repeated until strands of hair have been placed through each respective micro ring. The weft of material is then placed into position adjacent or as close to the scalp where the hair extension is to be installed. The micro rings are now closed around each corresponding strand of natural hair material so as to securely yet temporarily, fasten the hair extension system, to the scalp. This completes the initial step of installing the hair extension system to a scalp.

It will be appreciated that a re-touch process can be employed which allows the hair extension system to be loosened and repositioned as the head of hair grows outwardly over the following months.

To remove the hair extension system from the scalp, each micro ring is de-crimped, thus allowing the micro rings to disengage from its corresponding strand of hair.

This allows the hair system to be uninstalled, and reused, if desired. Thus, a reusable hair extension is provided which is durable, costs less and provides long lasting beauty.

BRIEF DESCRIPTION OF THE DRAWINGS

Referring now to the drawings, illustrative embodiments are shown in detail. Although the drawings represent some embodiments, the drawings are not necessarily to scale and certain features may be exaggerated, removed, or partially sectioned to better illustrate and explain the present invention. Further, the embodiments set forth herein are not intended to be exhaustive or otherwise limit or restrict the claims to the precise forms and configurations shown in the drawings and disclosed in the following detailed description.

DETAILED DESCRIPTION OF THE PREFERRED EMBODIMENTS

Figure 1:
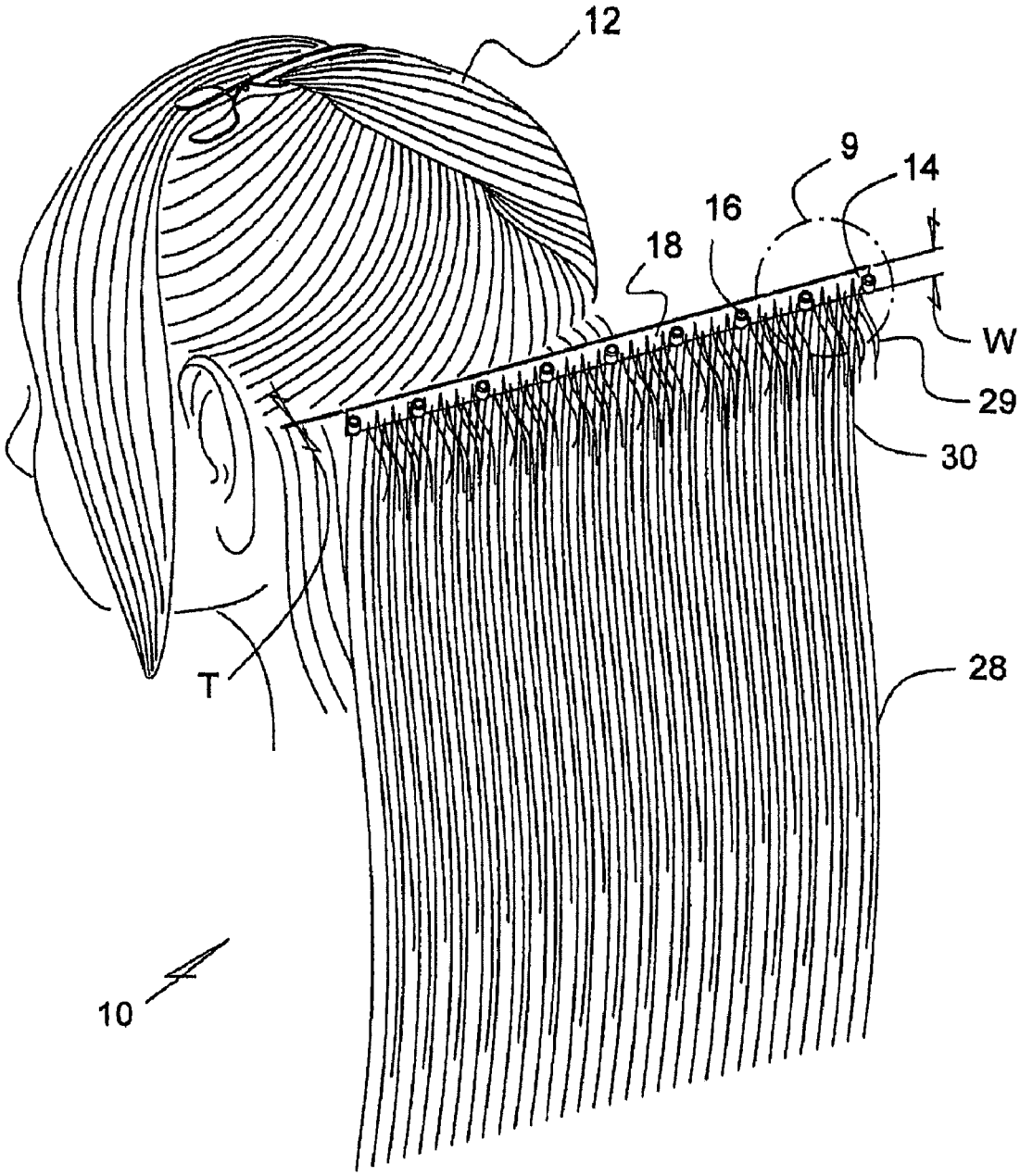
FIG. 1 is a rear perspective view of a hair extension section located adjacent to the back of a head.

With reference to FIG. 1, a hair extension system 10 is illustrated positioned adjacent to the head 12 or scalp of a human. The hair extension system includes a weft 14 of fibrous material that is provided in continuous lengths from a supplier. The weft may be made of an elastic type material and can be colored so as to match the scalp. The weft 14 has a thin cross section with a width w substantially greater than the thickness t. Micro rings 16 are spaced apart along an outer side 18 of the weft 14 and are secured to the weft 14, by a securing device such as thread or the like. It will be appreciated that the micro rings 16 can be affixed to the weft 14 in other conventional matters, not shown.

Figure 9:
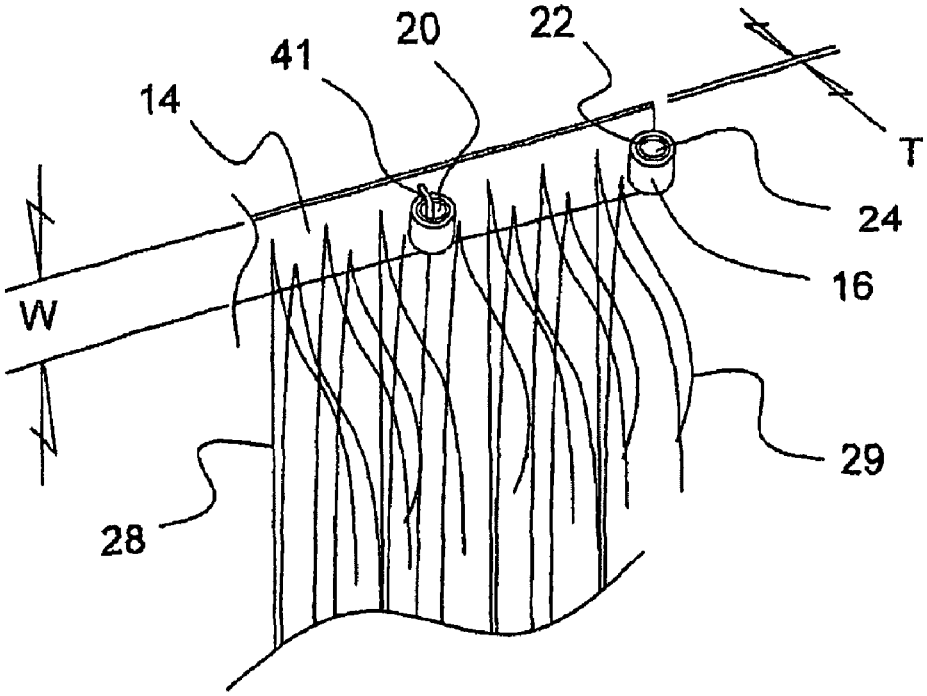
FIG. 9 is an enlarged perspective view of the micro rings in an opened state illustrating the cushion member positioned within the micro ring.

As can be seen in FIG. 9, each micro ring 16 has an opening 20 that is operable to receive an insert 22. The insert 22 has an outside diameter that is sized to be received within the opening 20. The insert 22 further has an aperture 24 extending across a substantial portion of the insert so as to be able to receive strands 26 of natural hair from the human. The micro ring 16 is positioned on the weft 18 at a position adjacent to the top surface of the weft or it could be positioned spaced downwardly there from. The micro ring is oriented such that its central axis runs tangent to the top surface of the weft 18.

With reference to FIG. 1 again, the hair extension system 10 further includes strands of auxiliary hair 28 that are dispersed evenly along the outer surface 18 of the weft 14. The auxiliary hair 28 can be artificial or natural hair depending upon the desired result. At one end 30, the auxiliary hair 28 is woven into the outer side 18 of the weft 14 in such a manner as to permanently affix the strand of auxiliary hair 28 to the weft of material. Once the auxiliary hair 28 is tied to the weft, a dangling portion or mustache 29 remains and provides thickened portion to the hair extension.

The weft 14 is preferably made of flexible, resilient skin-like material and is easily blended into the scalp of a human head 12. The micro rings 16 are preferably made of metal, and possibly copper, as this malleable material proves to be reusable. It will be appreciated that other material may be used. The insert 22 is preferably made of silicon, or the like, and is securely positioned within the opening 20 of each micro rings 16. Various fastening means can be utilized in order to secure the insert 22 within the opening 20, including adhesives and a press fit arrangement.

Figure 2:
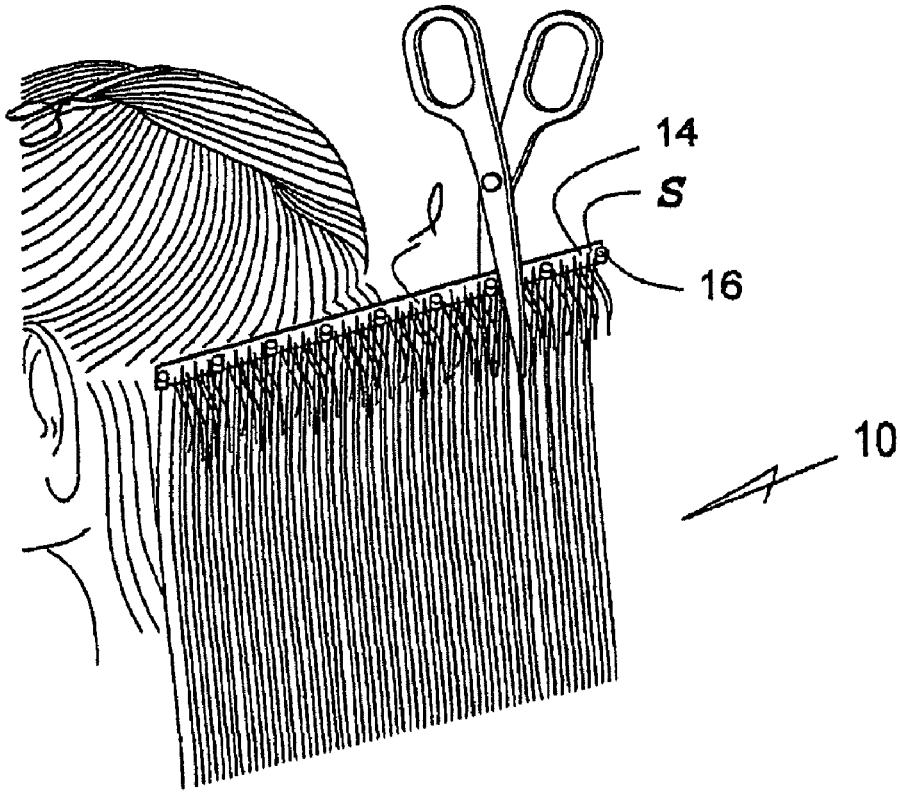
FIG. 2 is a perspective view illustrating the step of cutting the hair extension section to a desired length.

With reference to FIG. 2, the step of cutting the weft 14 to a desired length l is illustrated. The length l should be sufficient so as to span the area the user desires to have covered on her head. The remaining section S, can be later used for installation at a later location and time. The hair extension is oriented such that the micro rings face away from the scalp.

Figure 3:
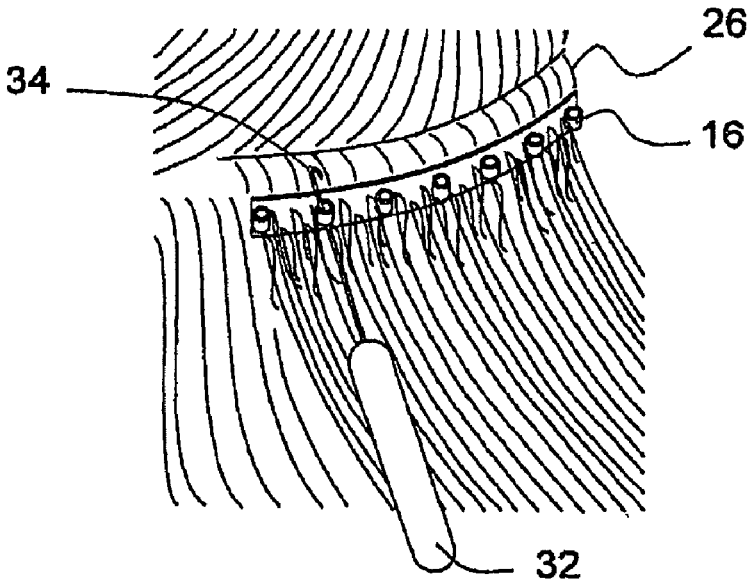
FIG. 3 is an enlarged view illustrating a tool extending up through a micro ring and grasping hair fibers.
Figure 4:
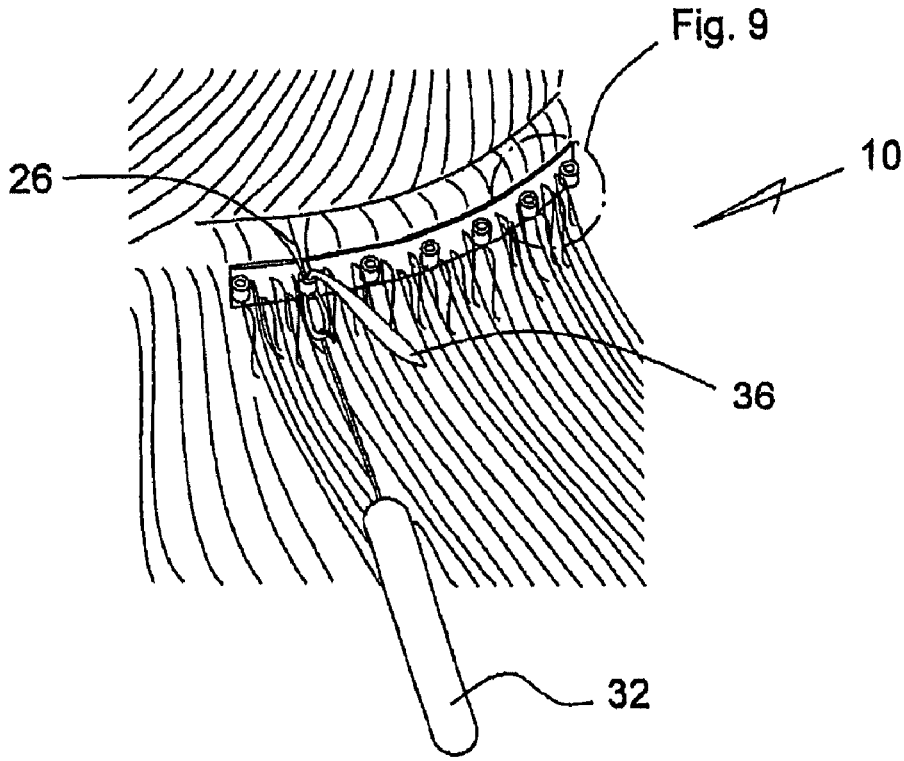
FIG. 4 is an enlarged view illustrating a strand of natural hair being pulled through a micro ring.

With reference to FIGS. 3 and 4, the step of pulling a strand of natural hair 26 through the micro rings 16 are illustrated. During the pulling step, a tool 32 having a hook shaped member 34 is utilized for grasping an entire strand 36 of natural hair 26. This is accomplished by placing the hook shaped member 34 up through the bottom of the aperture 24 and grabbing the natural hair 26 in a U shaped movement so as to capture hair in the area near the micro ring. This step is repeated for each micro ring 16 that is spaced along the weft 14.

Figure 5:
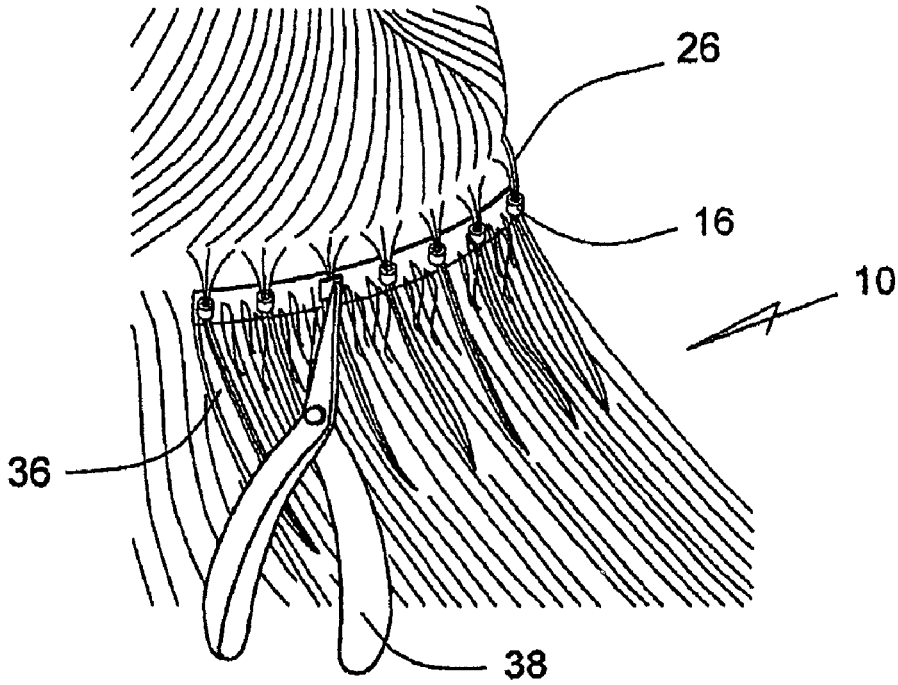
FIG. 5 illustrates a micro ring being closed round a natural strand of hair.

FIG. 5 illustrates the step of a mechanical crimper 38 collapsing the periphery of a micro rings 16 so as to cause it to deform around the strand 36 of natural hair. This action causes the insert 22, which is pliable, to close tightly around the strand 36 of natural hair thus causing a mechanical grip there between. The insert 22 acts a protectant to the natural hair 28, thus minimizing damage thereto. It will be appreciated that other insert 22 type material may be used, as long as it has memory and provides a positive gripping feature while protecting the hair. The pressure applied by the mechanical closure 38, needs to be sufficient pressure so as to deform the micro rings 16 such that the insert 22 entirely grips the strand 36.

Figure 6:
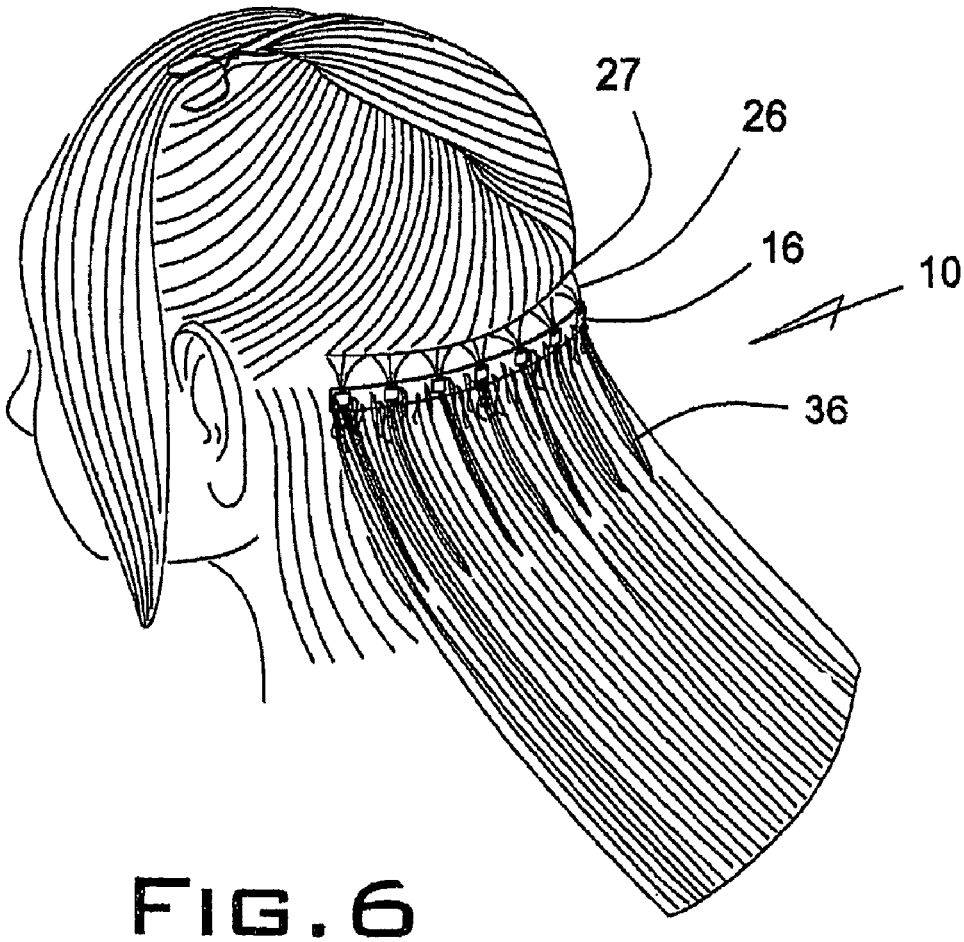
FIG. 6 illustrates the hair extension attached to the back of the head.

With reference to FIG. 6, each micro ring 16 is shown having been closed and secured onto its own strand 36 of natural hair. The hair extension 10 is preferably positioned such that the weft 14 is positioned up near a parting line 37 and tight against the head 12 as possible. At this point, a new parting line can be established and the next hair extension 10 can be secured to the head 12. This will be repeated until the consumer has the desired number of hair extension installed. At this time, the remainder of the hair can be let down which in turn overlays the hair extensions so as to provide a uniform hair display.

Figure 7:
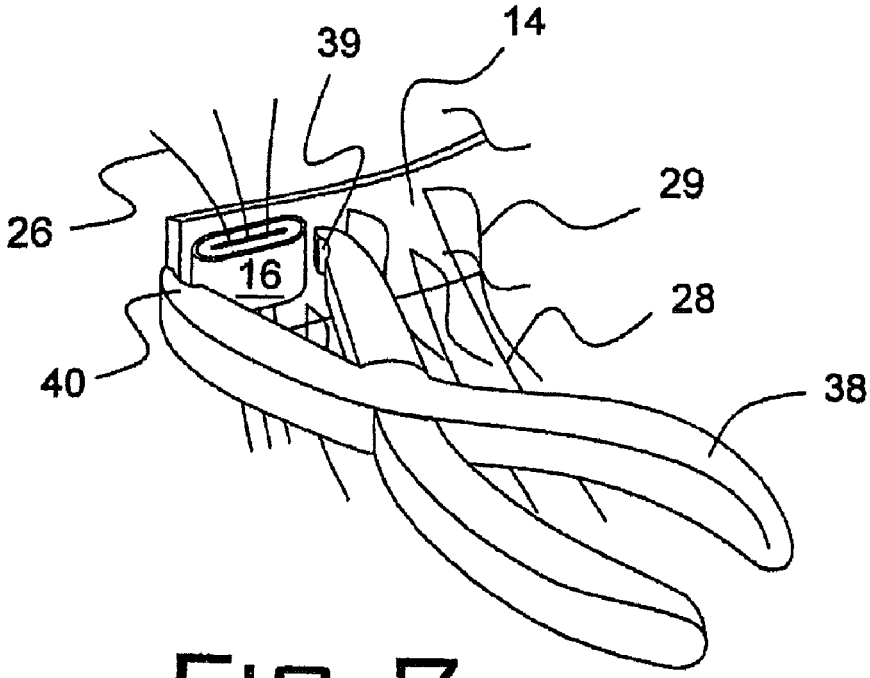
FIG. 7 illustrates a tool used for re-opening a micro-ring and the jaws opened and surrounding a closed micro ring.

With reference to FIG. 7, another unique aspect of the present invention is illustrated wherein an improved re-opening tool 38 is shown re-opening a micro ring 16. The tool 38 has a crescent shaped portion 39 at its tip 40 that is configured to mateingly engage a closed micro ring. By applying force to the handle of the tool 38, the micro rings 16 can be re-formed back towards their original circular-shaped configuration, thus releasing the strand 36 of hair from the micro rings 16. This action allows the insert 22 to likewise flex back to its original circular-shape, thus creating a clearance for the strand 36 to be removed there from. Thus, it is important for the insert material to have a memory. This step of re-opening is repeated for each of the micro rings 16 on the weft 14.

Figure 8:
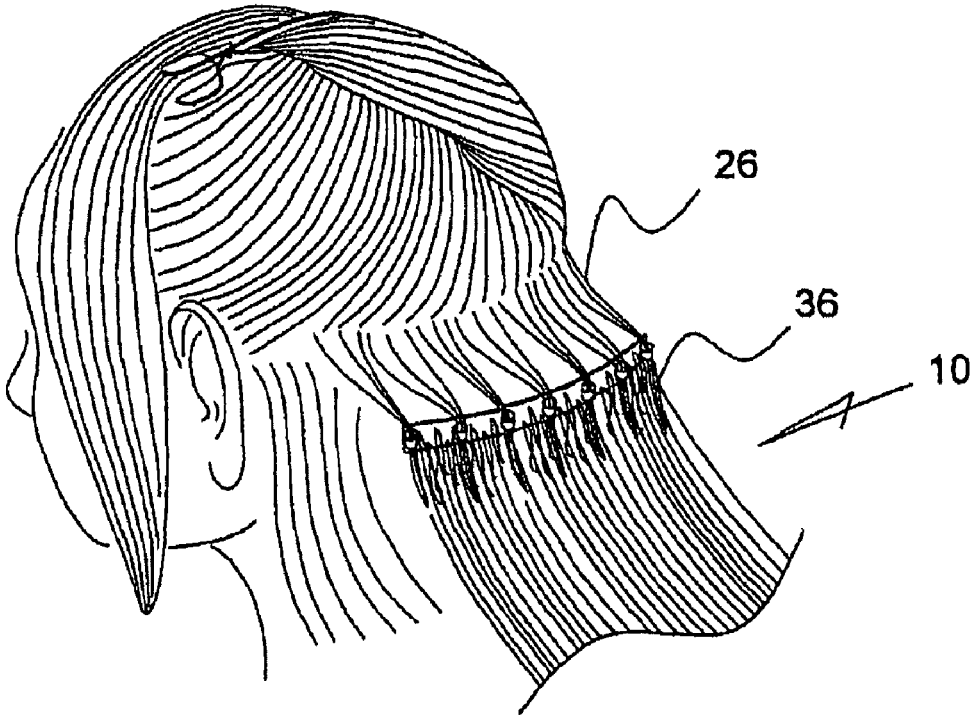
FIG. 8 illustrates the step of the hair extension being removed from the natural strands of hair.

With reference to FIG. 8, the hair extension 10 is shown being removed from the strands 36 of natural hair 26. This allows a hair extension system 10 to be reused at a later time. This can be accomplished because, in part, due to the resilient nature of the clamping member or micro rings 16.

It will be appreciated that instead of removing the hair extension from the head, the extension 10 can be repositioned upwards back up near the scalp. This may be particularly useful when the consumer's hair has grown out over a period of time and the consumer would like to reuse the extension.

FIG. 9 is a partial view taken from FIG. 1 showing an end portion of the hair extension 10 enlarged. The micro ring 16 is secured to the weft and a plurality of hair fibers 28 are displaced in a pattern on the face of the weft. Each fiber 28 is preferably tied to the weft, but it will be appreciated that other securing methods could be employed. Each micro ring 16 has the insert 22 shown positioned with the opening 20.

A shortened portion 29 extends from the weft 14 and an attachment portion 41 is secured to the weft with an elongated portion 28 that is longer than the shortened portion. The shortened portion, attachment portion and elongated portion are made of one continuous strand of hair-like fiber. See also FIGS. 10 and 11. The hole 24 provides a clearance for the strands 36 of hair to project there through. The micro ring 16 is placed close to the edge of the weft so as to improve fit and finish to the scalp.

Figure 10:
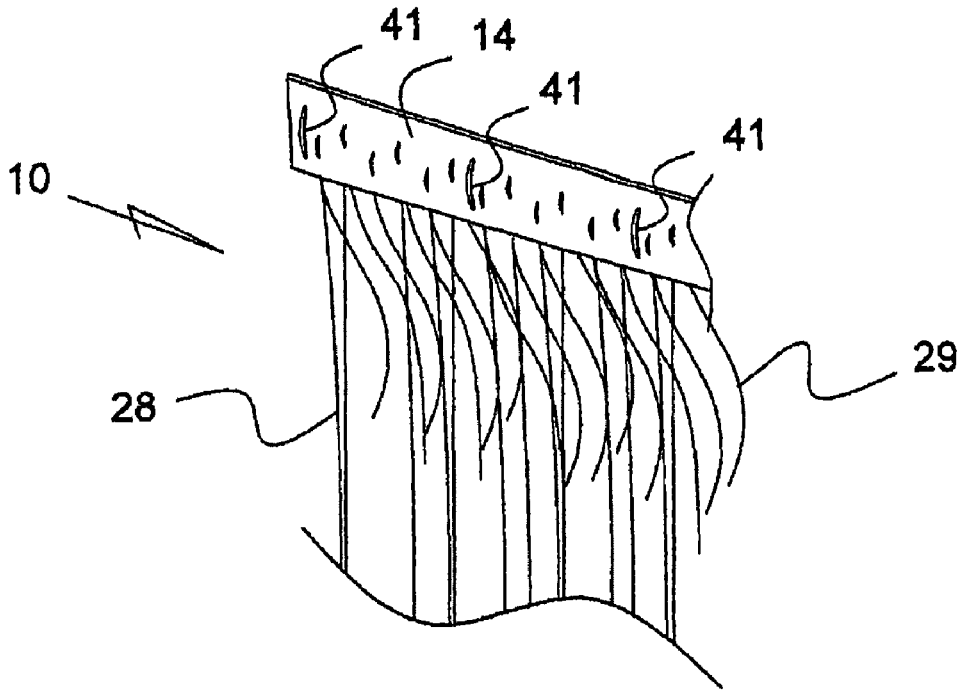
FIG. 10 is an enlarged perspective view of the back side of the weft of the hair extension showing the device for connecting the micro ring to the weft.

FIG. 10 is a view of the back side of a portion of the weft 14 showing the stitches 41 or threads protruding out of the back surface of the weft 14 with the opposite side thereof passing through the opening 24 of the insert 22. It will be preferred that multiple stitches be used to firmly secure each micro ring 16 to the weft 14. The individual hair fibers 28 pierce through the weft too and are weaved back to the front fact 18.

Figure 11:
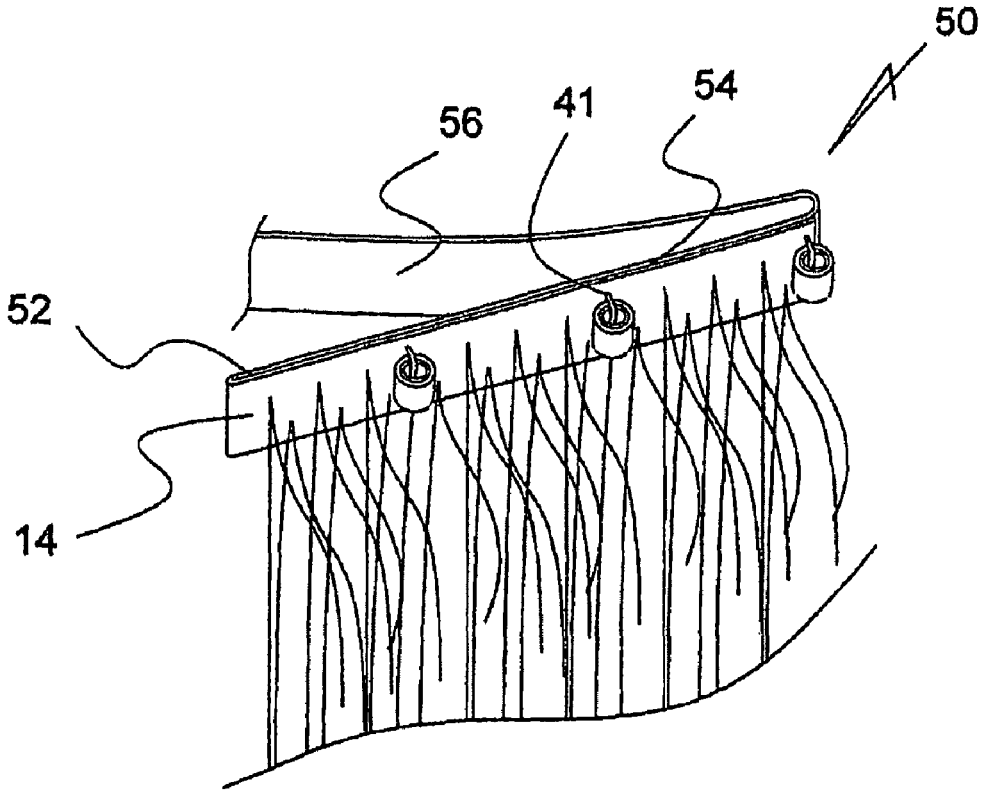
FIG. 11 is an alternative embodiment hair extension with a double back layer of weft material.

FIG. 11 is an alternative embodiment hair extension system 50 where the weft 14 is doubled backed with another layer 52 to form two layers which results in a doubling of the hair density. The weft can be cut to a desired length as before describe herein. The micro rings 16 are removed from one of the sides so as to form a single sided configuration. An adhesive 54 may be sandwiched between the two layers so as to secure them together. It will be appreciated that other bonding methods could be used to secure them together. It will be further appreciated that a third layer 56 could be added that too is bonded to its adjacent second layer so as to provide yet additional hair density.

Figure 12:
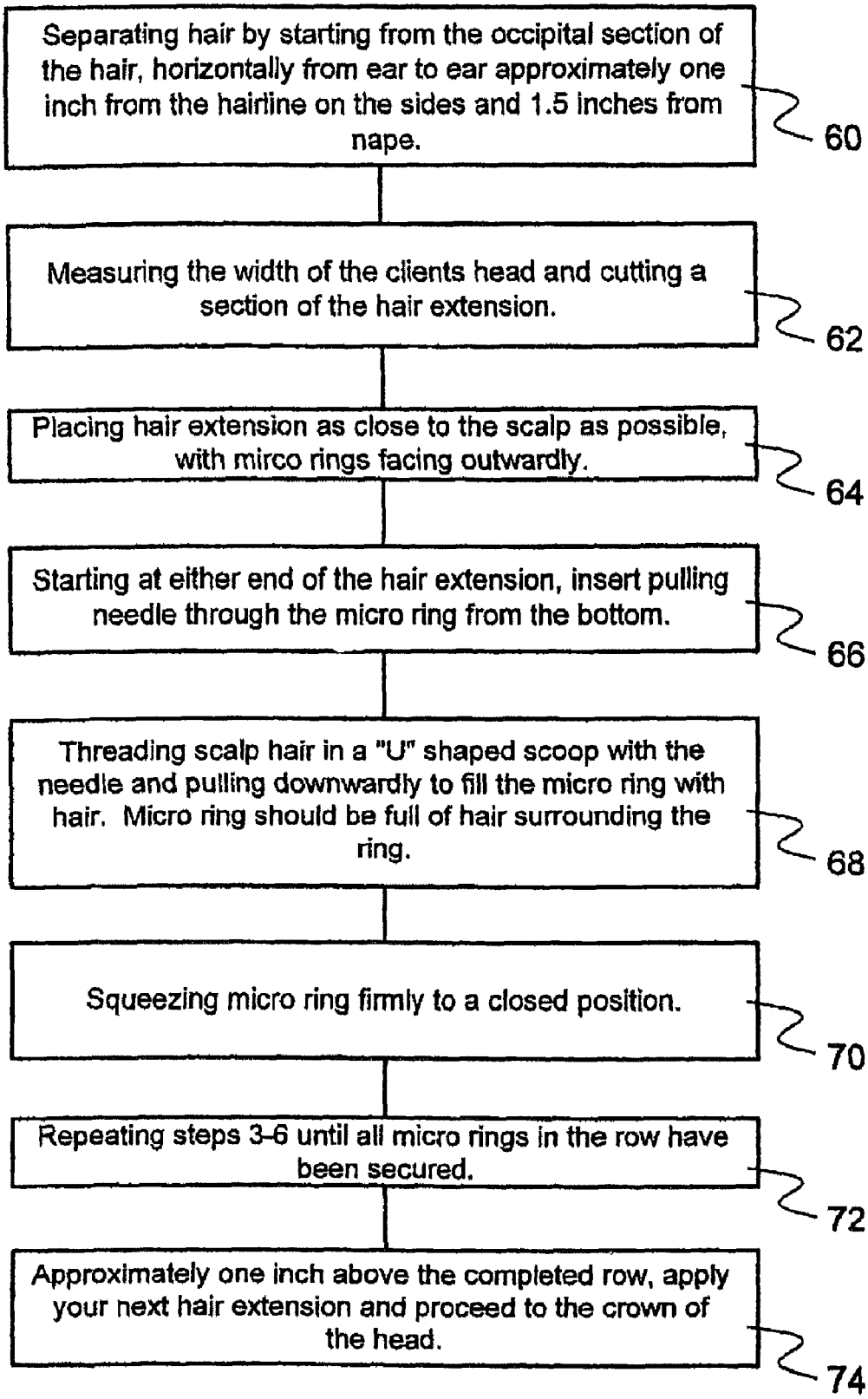
FIG. 12 is a flowchart illustrating the steps associated with installing the hair extension to a head of hair.

FIG. 12 is a schematic diagram of the steps for installing the novel hair extension system 10. This novel method of installation can be repeated due to the reusable nature of the hair extension system 10. To get started the weft 14 of material is unrolled. It will be appreciated that it can come in a variety of lengths, depending upon the supplier. It will also be appreciated that the micro rings 16 can be spaced at different distances, as desired. The micro rings 16 come already formed on and a part of the weft 14.

The first step includes separating 60 the hair on the human head into distinct segments on the scalp. It is preferred to start from the occipital section of the hair, and then horizontally separate from ear to ear approximately one inch from the hair line on the sides and one and one-half inches from the nape.

The next step includes measuring 62 the width of the customer's head section and cutting the proper length l of the weft 14. One should be careful not to cut too close to a micro rings 16. The next step includes placing 64 the cut hair extension 10 section having a length l, and placing the cut section as close as possible to the scalp 12. One should carefully align the cut section relative to the scalp, so as to maintain proper orientation thereof.

The next step includes pulling strands 36 of natural hair 26 through the micro rings 16 by use of a hook-shaped member 34. This is done by inserting 66 the hook-shaped member 34 up through the bottom of the micro rings 16 and through the corresponding opening 20, of the insert 22. The next step requires threading scalp hair in a "U" shaped movement 68 with the pulling needle 34. The hook shaped member 34 then gathers collected natural hair and then traverses downwardly through the aperture 24 until a strand 36 has been fully extended through the micro ring 16. This step is repeated for each micro ring on the weft.

The next step includes closing 70 each micro ring 16 so as to allow each strand 36 to be secured to its corresponding micro ring 16. This step is repeated 72 until each micro ring in the row is closed. The hair extension 10 has now been fully connected to the head of hair.

The final step is to apply 74 your next section of hair extension 10 and repeat the steps above until that new section has been installed.

To remove the hair extension system 10 from the scalp 12, each micro ring 16 is de-crimped thus allowing the strands 36 of hair to be disengaged from the hair extension system 10. This allows re-use of the extension system 10 over and over again.

The preceding description has been presented only to illustrate and describe exemplary embodiments of the methods and systems. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A hair extension system for use with human hair that adorns the appearance of human hair, the hair extension system comprising:

a hair extension of predetermined size, said hair extension including a flattened weft portion with hair portions connected thereto, a plurality of malleable rings secured to one side of the weft, each ring having an opening and a resilient insert located within each said opening;

said weft portion further including colored elastic skin like material and hair woven into said material, said weft further including mustache portions to provide a thickened hair portion, said mustache portions are disbursed in between each of the rings, said mustache portions include a shortened portion that extends from said weft, an attachment portion that is secured to the weft, and an elongated portion that extends from the weft and is longer than the shortened portion, the shortened portion, attachment portion and elongated portion are made of one continuous strand of hair-like fiber.

2. The hair extension system as claimed in claim 1, further comprising:

a strand of human-like hair extending through said opening in one of said rings;

a ring temporarily secured to the ring to the strand of human-like hair; and a second strand of human-like hair extending through an opening in a second ring;

wherein second ring is crimped to the second strand of hair to temporarily secure the second strand to the second ring.

3. The hair extension system as claimed in claim 1, wherein the rings are located on the side of the weft opposite a scalp of a human.

4. The hair extension system as claimed in claim 1, further including a mechanical device to apply pressure to a ring, said ring deforms causing the insert to collapse around the strands of human-like hair.

5. The hair extension system as claimed in claim 1, wherein the hair extension is provided in rolls which can be cut to various lengths according to a users' head profile.

6. A hair extension for use with a scalp, the hair extension comprising:

a length of hair extension, said hair extension having a weft portion with hair members secured thereto, and a securing member positioned on a side of the weft portion, the securing member having an aperture wherein an insert is positioned within the aperture;

said weft portion further including colored elastic skin like material and hair members woven into said material, said weft portion further including a mustache portion of substantially shorter hair members affixed to the weft portion to provide a thickened hair portion adjacent the weft portion, said shorter hair members are woven through the weft, said hair members include an elongated portion that extends from the weft a distance longer than the shorter hair members;

said mustache portion is disbursed in between each securing member; and a plurality of strands of human-like hair.

7. The hair extension for use with a scalp as claimed in claim 6, further comprising strands of natural-like hair being threaded through the securing member.

8. The hair extension for use with a scalp as claimed in claim 6, wherein the securing member is a ring, the ring is operable to selectively engage and disengage strands of hair-like members.

9. The hair extension for use with a scalp as claimed in claim 6, wherein the hair extension is re-useable.

10. The hair extension for use with a scalp as claimed in claim 6, wherein the securing member has an insert that engages at least one strand of hair-like member.

11. A hair extension system for use in connection with a human scalp, the system comprising:

a weft having a thin profile and an upper surface, said weft comprised of colored elastic skin like material;

hair fibers spaced apart and woven into the weft; the hair fibers each having a first long portion extending from one side of the weft and a second portion substantially shorter than the first portion extending from the other side of the weft to form a mustache portion of increased hair density adjacent the weft, said first long portion and said second portion are one continuous strand of fiber;

at least one link secured to said weft at a location near the upper surface, said link having an aperture;

said mustache portion is disbursed in between each link; and an insert positioned within the aperture of said link, the insert having an opening for receiving hairs from the human scalp.

12. The hair extension system as claimed in claim 11, wherein said insert is made of silicon.

13. The hair extension system as claimed in claim 11, wherein said link is made of formable material.

14. The hair extension system as claimed in claim 11, wherein the aperture in said link has a diameter sufficiently large to receive a hook member.

15. The hair extension system as claimed in claim 11, further comprising a first weft layer, a second layer positioned adjacent the first weft layer and an adhesive disposed between said first and second weft layers, each said weft layer having hair fibers spaced apart and affixed thereto, and said weft layers cooperating to form a hair extension system having increased hair density.

16. The hair extension system as claimed in claim 11, wherein the hair fibers are evenly spaced apart on the weft.

17. The hair extension system as claimed in claim 11, wherein the link can be crimped, un-crimped and re-crimped for reuse.

18. The hair extension system as claimed in claim 11, further comprising an adhesive to attach the first layer to the second layer.

* * * * *